US011073000B2

(12) United States Patent
Oppolzer

(10) Patent No.: US 11,073,000 B2
(45) Date of Patent: Jul. 27, 2021

(54) METHOD OF GENERATING A DRILL HOLE SEQUENCE PLAN AND DRILL HOLE SEQUENCE PLANNING EQUIPMENT

(71) Applicant: Technological Resources Pty Ltd, Brisbane (AU)

(72) Inventor: Florian Oppolzer, Brisbane (AU)

(73) Assignee: Technological Resources Pty Limited, Melbourne (AU)

( * ) Notice: Subject to any disclaimer, the term of this patent is extended or adjusted under 35 U.S.C. 154(b) by 559 days.

(21) Appl. No.: 14/770,149

(22) PCT Filed: Feb. 25, 2014

(86) PCT No.: PCT/AU2014/000176

§ 371 (c)(1),
(2) Date: Aug. 25, 2015

(87) PCT Pub. No.: WO2014/131080

PCT Pub. Date: Sep. 4, 2014

(65) Prior Publication Data

US 2016/0003009 A1 Jan. 7, 2016

(30) Foreign Application Priority Data

Feb. 27, 2013 (AU) ..... 2013900662

(51) Int. Cl.

| | |
|---|---|
| ***E21B 44/00*** | (2006.01) |
| ***E21B 43/30*** | (2006.01) |
| ***E21B 41/00*** | (2006.01) |
| ***E21B 7/02*** | (2006.01) |

(52) U.S. Cl.

CPC ..... *E21B 41/0092* (2013.01); *E21B 7/02* (2013.01); *E21B 7/022* (2013.01); *E21B 41/00* (2013.01); *E21B 43/30* (2013.01); *E21B 44/00* (2013.01)

(58) Field of Classification Search

CPC ..... E21B 44/00
USPC ..... 166/245, 52
See application file for complete search history.

(56) References Cited

U.S. PATENT DOCUMENTS

2004/0216922 A1* 11/2004 Koivunen ..... E21B 7/022 175/24
2012/0024605 A1 2/2012 Elinas et al.
2012/0103598 A1* 5/2012 Nadeau ..... E21B 43/30 166/245

FOREIGN PATENT DOCUMENTS

WO 2008129128 A1 10/2008
WO 2012072870 A1 6/2012

OTHER PUBLICATIONS

International Search Report—PCT/AU2014/000176—dated May 8, 2014.

* cited by examiner

*Primary Examiner* — Robert E Fuller
*Assistant Examiner* — Lamia Quaim
(74) *Attorney, Agent, or Firm* — Banner & Witcoff, Ltd.

(57) ABSTRACT

Drill hole sequence planning equipment (14) includes a position determining module (18) for determining an initial location of a mobile drill rig (12). A selection module (24) selects a destination location for the drill rig (12). A corridor establishment module (26) establishes a corridor between the initial location of the drill rig (12) and its destination location, the corridor having a selected width. A processing unit (28) is responsive to the modules (18, 24 and 26) for selecting a hole location of each hole within the corridor to be drilled by the drill rig (12) sequentially as it moves from its initial location to its destination location.

18 Claims, 7 Drawing Sheets

METHOD OF GENERATING A DRILL HOLE SEQUENCE PLAN AND DRILL HOLE SEQUENCE PLANNING EQUIPMENT

CROSS-REFERENCE TO RELATED APPLICATIONS

The present application is a U.S. National Phase filing of International Application No. PCT/AU2014/000176, filed on Feb. 25, 2014, designating the United States of America, and this application claims priority from Australian Provisional Patent Application No 2013900662 filed on 27 Feb. 2013, the contents of which are incorporated herein by reference.

TECHNICAL FIELD

This disclosure relates, generally, to the operation of drills and, more particularly, to a method of generating a drill hole sequence plan, to a method of operating a drill rig, to drill hole sequence planning equipment and to a drill rig control system. The disclosure has particular, but not necessarily exclusive, application in the field of blast hole drilling in open cut mines but those skilled in the art will appreciate that it could be used in other applications such as exploration hole drilling and also in underground mining applications where arrays of holes are to be drilled.

BACKGROUND

In mining operations, particularly in open cut mines, a drill hole pattern containing details relating to blast holes to be drilled at a mine site, such as a bench, is provided to a drill rig operator. The details of the blast holes include data relating to the coordinates of each hole to be drilled as well the depth of each hole to be drilled. The details may also contain the type of drilling to be carried out, i.e. rotary or percussive.

The applicant has developed autonomous drill technology which enables a drill rig to tram to a hole location and to drill a blast hole at that location autonomously. However, the drill rig still needs to be controlled at some steps during the blasting of a sequence of holes. More particularly, the drill rig operator still needs to select the following hole to be drilled and to provide the data relating to the following hole to be drilled to a control unit of the drill rig. This reduces the efficiency of the drilling operation.

SUMMARY

In a first aspect, there is provided a method of generating a drill hole sequence plan, the method including determining an initial location of a mobile drill rig;

selecting a destination location of the drill rig;

establishing a corridor between the initial location of the drill rig and its destination location, the corridor having a selected width; and selecting a hole location of each hole within the corridor to be drilled by the drill rig sequentially as it moves from its initial location to its destination location.

The method may include selecting the width to have a known safe bound of a path of the drill rig. The method may further include an operator manually selecting a width of the corridor.

The method may include, initially, accessing a hole pattern of holes to be drilled by the drill rig. The hole pattern may include coordinates of each hole location and a depth of each hole to be drilled by the drill rig.

The method may include establishing the corridor on the hole pattern.

The method may include performing a distance check to see if a hole location falls within, or within a configurable distance from, the corridor. The method may include configuring the corridor to cover hole locations along a tramming path of the drill rig from its initial location to its destination location.

The method may include selecting an end hole location as the destination location of the drill rig. While the destination location will generally be the location of an end hole to be drilled by the drill rig, it will be appreciated that the end location could be any other suitable destination location such as, for example, an egress point for enabling the drill rig to exit a bench after completion of drilling the blast hole pattern for that bench.

The method may include generating a start position of the corridor at a location which is spaced from the initial location of the drill rig.

The disclosure extends to a method of operating a drill rig, the method including providing to a drill rig controller a drill hole sequence plan as generated using the method as described above; and causing the drill rig, which is responsive to the drill rig controller, to drill a hole automatically at each hole location sequentially along its path as the drill rig traverses the corridor.

The term "automatically" is to be understood, unless the context indicates otherwise, as being a system decision and not an operator decision.

In a second aspect, there is provided drill hole sequence planning equipment which includes a position determining module configured to determine an initial location of the drill rig;

a selection module configured to select a destination location for the drill rig;

a corridor establishment module configured to establish a corridor between the initial location of the drill rig and its destination location, the corridor having a selected width; and a processing unit responsive to the modules and configured to select a hole location of each hole within the corridor to be drilled by the drill rig sequentially as it moves from its initial location to its destination location.

The width of the corridor may be selected to have a known safe bound of a path of the drill rig. Further, the equipment may be configured to enable an operator manually to select a width of the corridor.

The modules may be implemented as hardware modules or as software modules. In the latter case the modules may form part of the processing unit.

The equipment may include an inputting module to enable a drill hole pattern to be entered into the processing unit.

The corridor establishment module may be operable to configure the corridor to include/exclude hole locations. The corridor establishment module may be configured to conduct a distance check on a hole location to determine if it should be included in, or excluded from, the corridor.

The corridor establishment module may further be configured to generate a start position of the corridor at a location which is spaced upstream from the initial location of the drill rig.

The processing unit may be configured to communicate with a drill controller to control the drill automatically to traverse the corridor and to drill holes at the hole locations falling within the corridor.

In a third aspect, there is provided a drill rig control system which includes drill hole sequence planning equipment as described above; and a drill controller, to which the drill rig is responsive, in communication with the drill hole sequence planning equipment.

The controller may be mounted on board the drill rig, the controller communicating wirelessly with the drill hole sequence planning equipment.

The disclosure extends still further to a drill rig which is responsive to drill hole sequence planning equipment as described above.

The disclosure also extends to software that, when installed on a computer, causes the computer to perform a method of generating a drill hole sequence plan as described above.

BRIEF DESCRIPTION OF DRAWINGS

An embodiment of the disclosure is now described by way of example with reference to the accompanying drawings in which.

DETAILED DESCRIPTION OF EXEMPLARY EMBODIMENT

Figure 1:
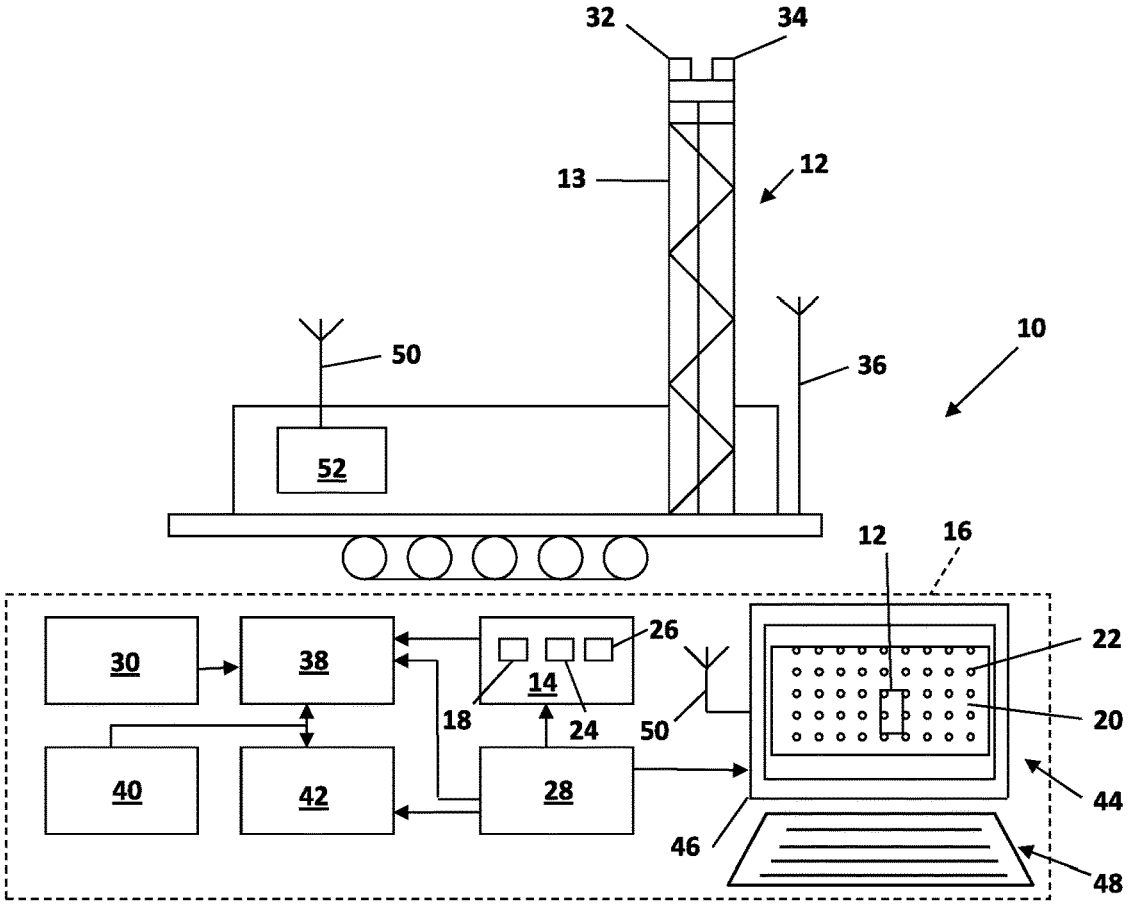
FIG. 1 shows a schematic block diagram of an embodiment of a drill rig control system including an embodiment of drill hole sequence planning equipment.
Figure 2:
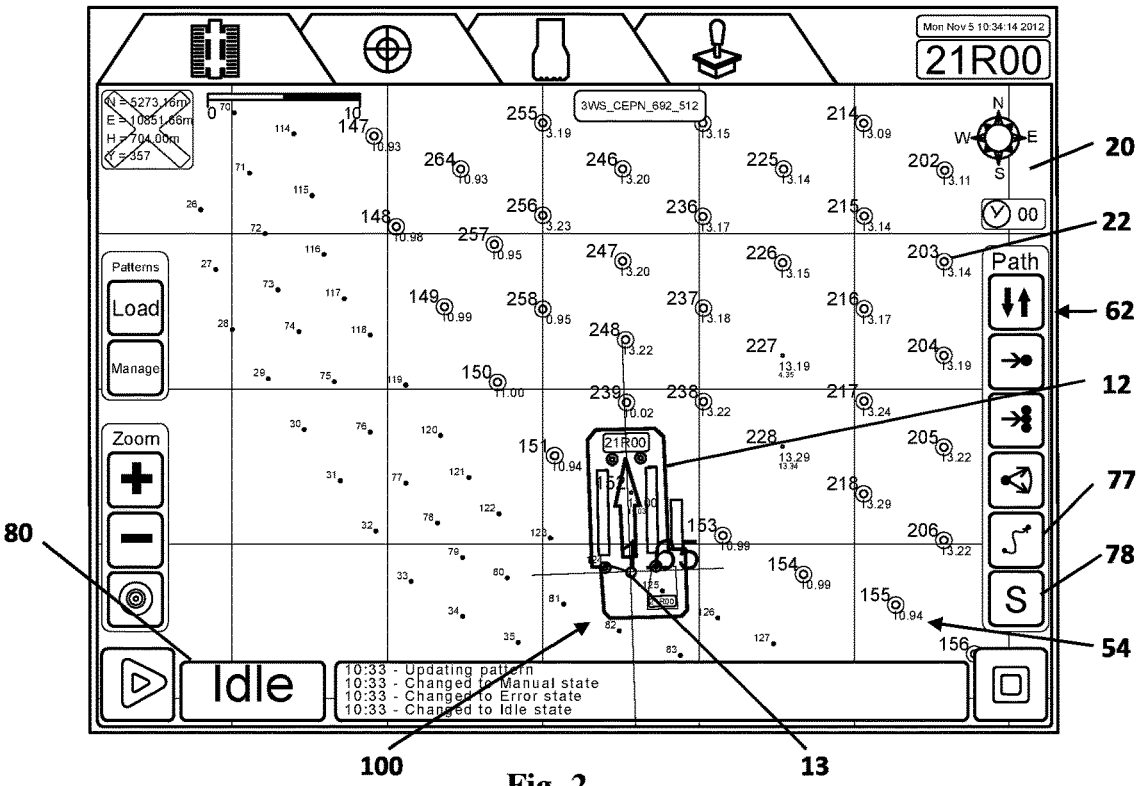
FIGS. 2-8 show screen shots depicting various steps of an embodiment of a method of operating a drill rig.
Figure 3:
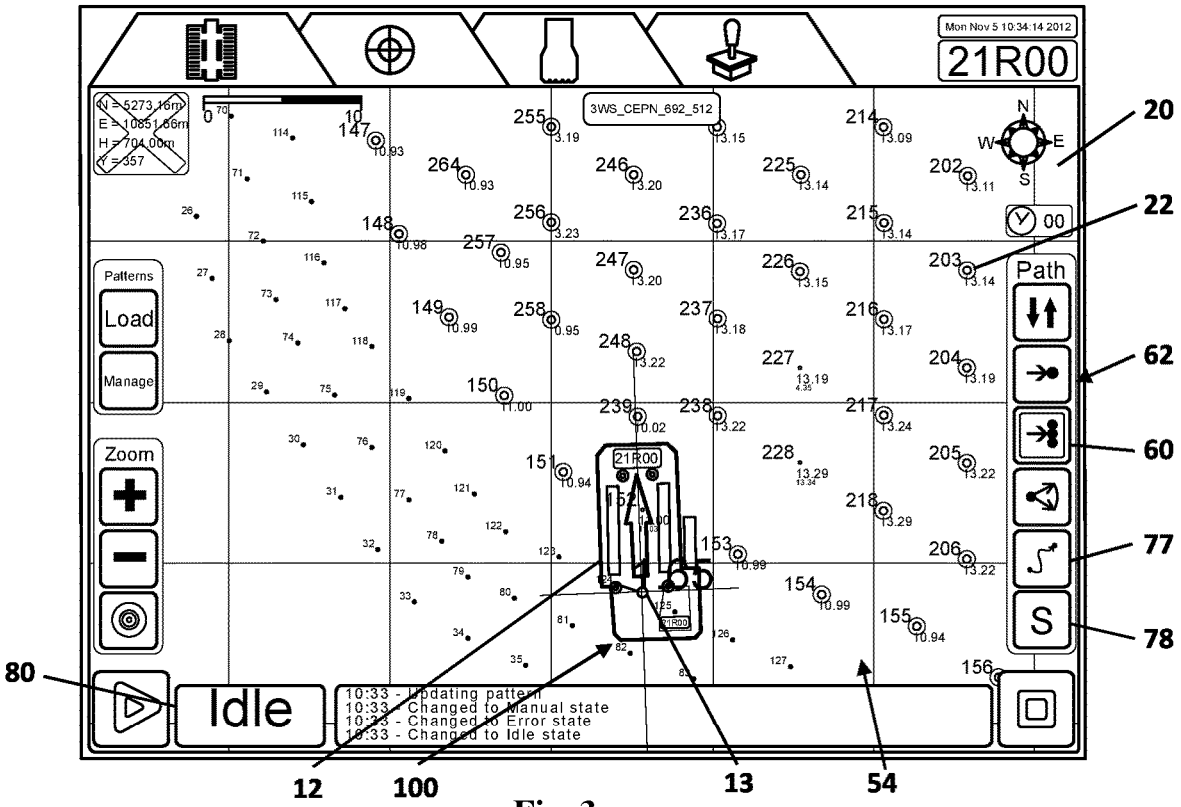

In FIG. 1 of the drawings, reference numeral 10 generally designates an embodiment of a drill rig control system. The drill rig control system 10 controls a drill rig 12. The control system 10 includes an embodiment of drill hole sequence planning equipment 14.

The equipment 14 constitutes part of a drill rig operating system 16. In an embodiment, the drill rig operating system 16 is an automated drill rig operating system which permits the drill rig 12 to operate in an autonomous mode.

Further, the equipment 14 is, in an embodiment, implemented in software and comprises various software modules. More particularly, the equipment 14 has a position determining module 18 for determining an initial location of the drill rig 12 at an operational location, such as a bench 20 of an open-cut mine into which the drill rig 12 is to drill blast holes 22, as will be described in greater detail below.

The equipment 14 further includes a selection module 24 for selecting a destination location for the drill rig 12 on the bench 20. Still further, the equipment 14 includes a corridor establishment module 26 for establishing a corridor between the initial location of the drill rig 12 on the bench 20 and the destination location on the bench 20, the corridor having a selected width, as will be described in greater detail below.

The equipment 14 includes a processing unit, forming part of a central processing unit or processor 28, of the drill operating system 16. The processor 28 is responsive to the modules 18, 24 and 26 for selecting a hole location of each hole in the corridor to be drilled by the drill rig 12 sequentially as it traverses the corridor from its initial location to its destination location.

While the equipment 14 of this embodiment of the disclosure has been developed particularly for use in open-cut mining for drilling of blast holes 22 in mine benches 20, those skilled in the art will appreciate that the equipment 14 can readily be used in other applications. These applications include, for example, drilling of exploration holes in an exploration zone, drilling an array of blast holes in a mine face of an underground mine or drilling rock bolting holes in a hanging wall of an underground mine. However, for ease of explanation, the equipment 14 will be described below with reference to its application in the drilling of blast holes 22.

The drill rig operating system 16 includes a navigation unit 30. The navigation unit 30 receives data from various input devices and/or sensors for determining the location of the drill rig 12 on the drill bench 20 with accuracy. The drill rig 12 includes a GPS unit 32, which, for example, is a high precision (HPGPS) unit, one or more video cameras 34 and other position determining systems such as wheel encoders, laser scanners, or the like. Data from the drill rig 12 mounted equipment are transmitted via a communications link 36 to the navigation unit 30 of the drill rig operating system 16. The navigation unit 30 determines the location of the drill rig 12 from the received information and provides the location information to the processor 28. The processor 28, in turn, provides the information to the position determining module 18 of the equipment 14 for enabling the initial location of the drill rig 12 on the bench 20 to be determined.

The drill rig operating system 16 further includes a tramming control module 38. The tramming control module 38 is used for the automated tramming of the drill rig 12 using information from the navigation unit 30.

Still further, the drill rig operating system 16 includes a safety module 40. The safety module 40 is responsible for monitoring the status of the drill rig 12, detecting possible collisions and implementing obstacle avoidance manoeuvres and/or taking other remedial action to prevent emergency situations arising.

The drill rig operating system 16 also includes a manual control module 42 for enabling an operator to override autonomous control of the drill rig 12 and to assume manual control of the drill rig 12. Manual control can either be effected from a cabin of the drill rig 12 or via remote control.

The drill rig operating system 16 includes a user interface 44. The user interface 44 includes a display 46. The user interface 44 further has various inputting devices such as a keyboard 48, pointing devices (not shown), or touch screen facilities on the display 46. The user interface 44 receives inputs from the processor 38 of the system 16 and from the operator of the drill rig operating system 16.

Instructions and data from the drill rig operating system 16 are fed via a communications link 50 wirelessly to a controller 52 mounted on the drill rig 12.

The drill rig 12 includes a drill mast including a drill string (depicted schematically at 13 in FIGS. 2-9 of the drawings) located at a rear end region of the drill rig 12. Blast holes are generally drilled in a bench at a location directly beneath the drill string 13.

Referring now to FIGS. 2-9 of the drawings, an embodiment of a method of generating a drill hole sequence plan using the equipment 14 is described as well as an embodiment of a method of operating the drill rig 12.

To generate the drill hole sequence plan, a blast hole pattern 54 (FIGS. 2-9) is input into the drill rig operating system 16. The blast hole pattern 54 is generated externally of the system 16. The blast hole pattern 54 is, typically, designed by surveyors and blast planners using various software tools and taking into account various external factors such as the geology of the bench 20, the grade of ore in the bench 20, etc.

The blast hole pattern 54 is input into the system 16 in any one of a number of forms, for example, by being exported from blast hole pattern generating software to the drill rig operating system 16, via portable memory devices, suitable communications links (whether wireless or wired), or the like.

Figure 9:
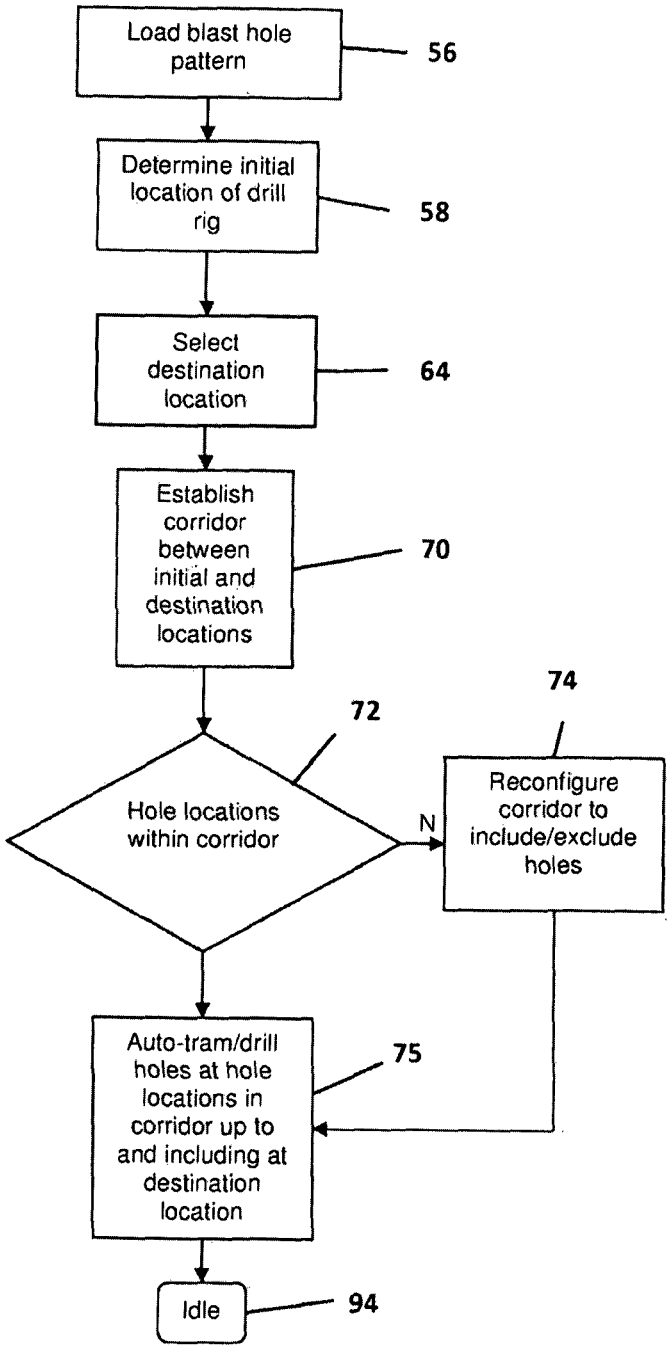
FIG. 9 shows a flow chart of steps in an embodiment of a method of generating a drill hole sequence plan and for controlling operation of the drill rig to execute the drill hole sequence plan.

Hence, as shown at step 56 in FIG. 9 of the drawings, the blast hole pattern 54 is imported into the drill rig operating system 16.

The equipment 14, using the position determining module 18, automatically determines the initial location of the drill rig 12 on the bench 20 and, specifically, the location of the drill string 13 relative to the blast hole pattern 54 as shown at step 58 using data from the navigation unit 30. The initial location of the drill rig 12 is shown at 100 in FIGS. 2 and 10 of the drawings.

Figure 4:
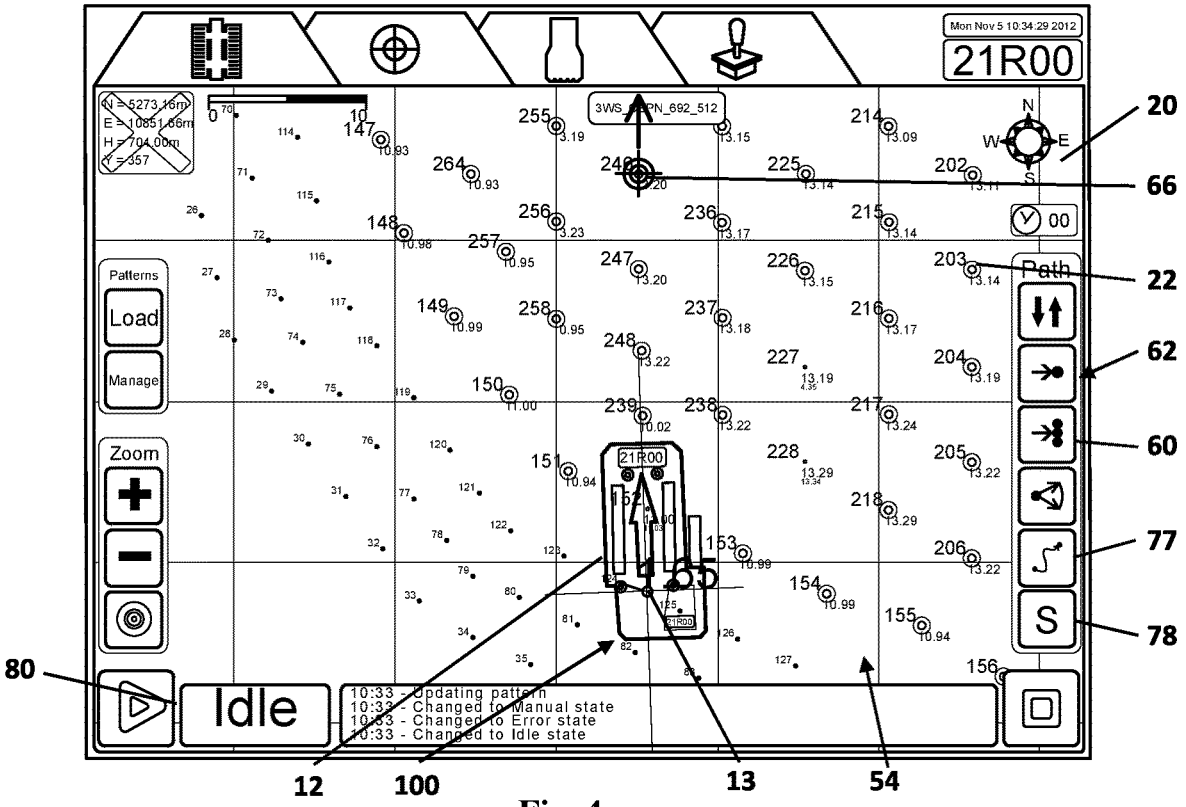
Figure 5:
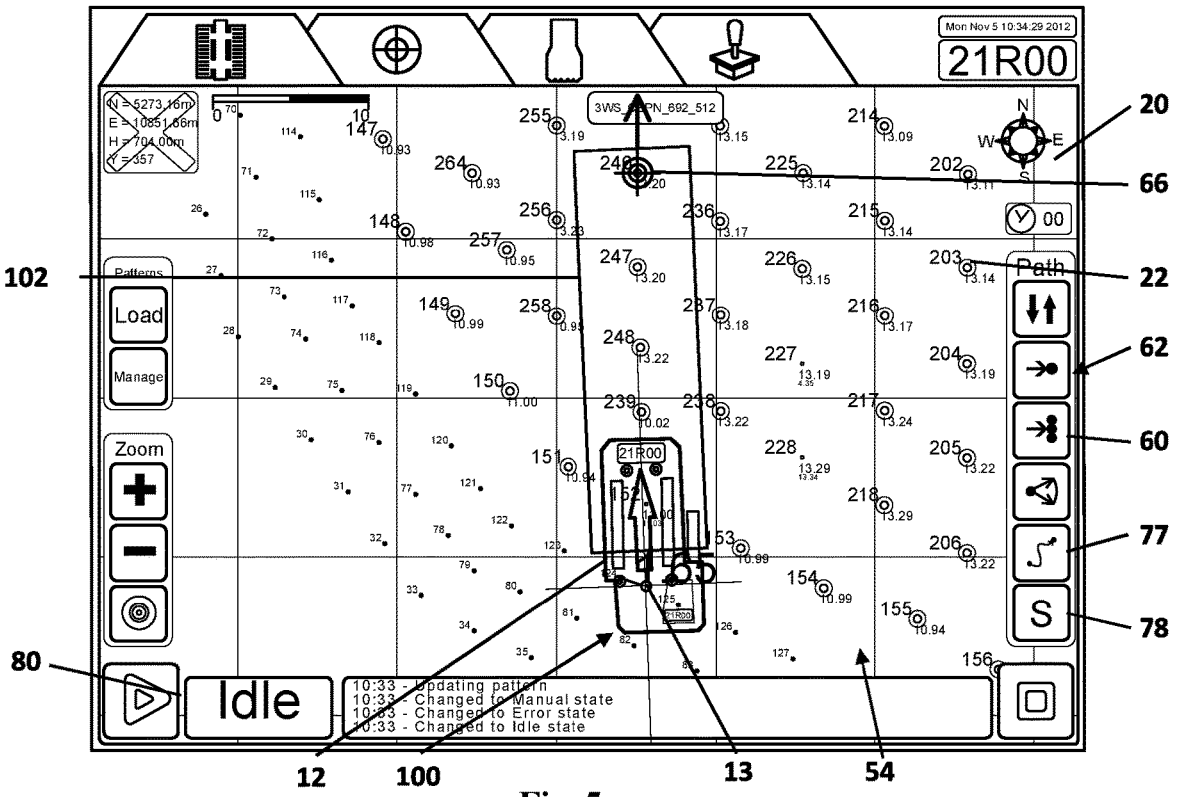

The operator selects a multihole target button 60 (FIG. 3) from an array 62 of buttons related to path planning which are displayed on the display 46 of the drill rig operating system 16. Once the target button 60 has been activated, at step 64, the selection module 24 of the equipment 14 prompts the operator to select a destination location for the drill rig 12. In this case, as shown in FIG. 4 of the drawings, the operator has chosen destination location 66, labelled hole number "246", in the blast hole pattern 54.

Once the destination location 66 has been selected, the corridor establishment module 26 of the equipment 14 determines a corridor 102 (FIGS. 5 & 10) between the initial location of the drill rig 12 and the destination location 66. This is shown at step 70 in FIG. 9 of the drawings. The corridor establishment module 26 of the equipment 14, using the data from the blast hole pattern 54, determines what blast hole locations are contained in the pattern which are within the corridor 102 as shown at step 72 in FIG. 9 of the drawings. As shown most clearly in FIG. 5 of the drawings, the holes to be drilled and labelled "152", "239", "248", "247" and "246" fall within the corridor 102.

In one embodiment, a width of the corridor 102 is configurable by the operator as a configurable input to the corridor establishment module. As will be appreciated, the wider the selected corridor, the more blast hole locations are likely to fall within the corridor 102 and, conversely, when a narrower corridor is selected the fewer the number of blast holes that will fall within the corridor 102. Also, by establishing a corridor 102 of a selected width it provides a known safe bound for a path of the drill rig 12.

Figure 6:
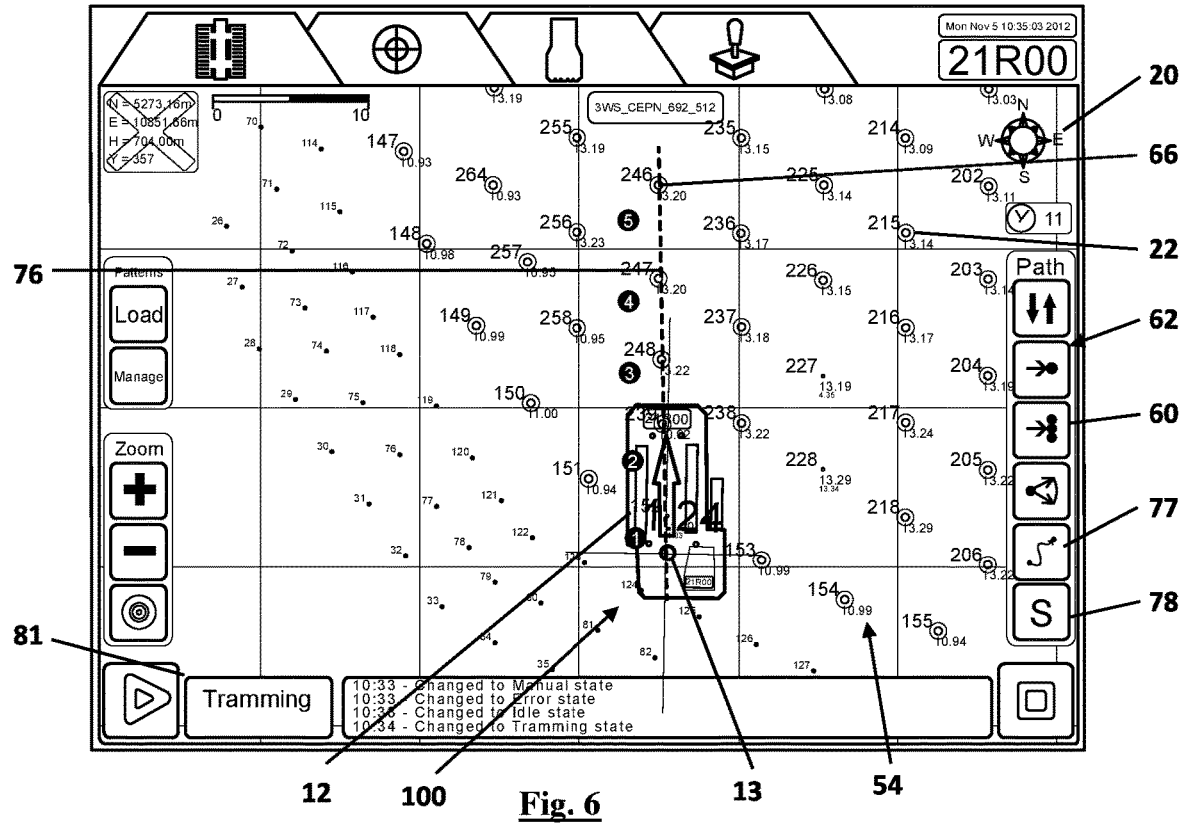
Figure 7:
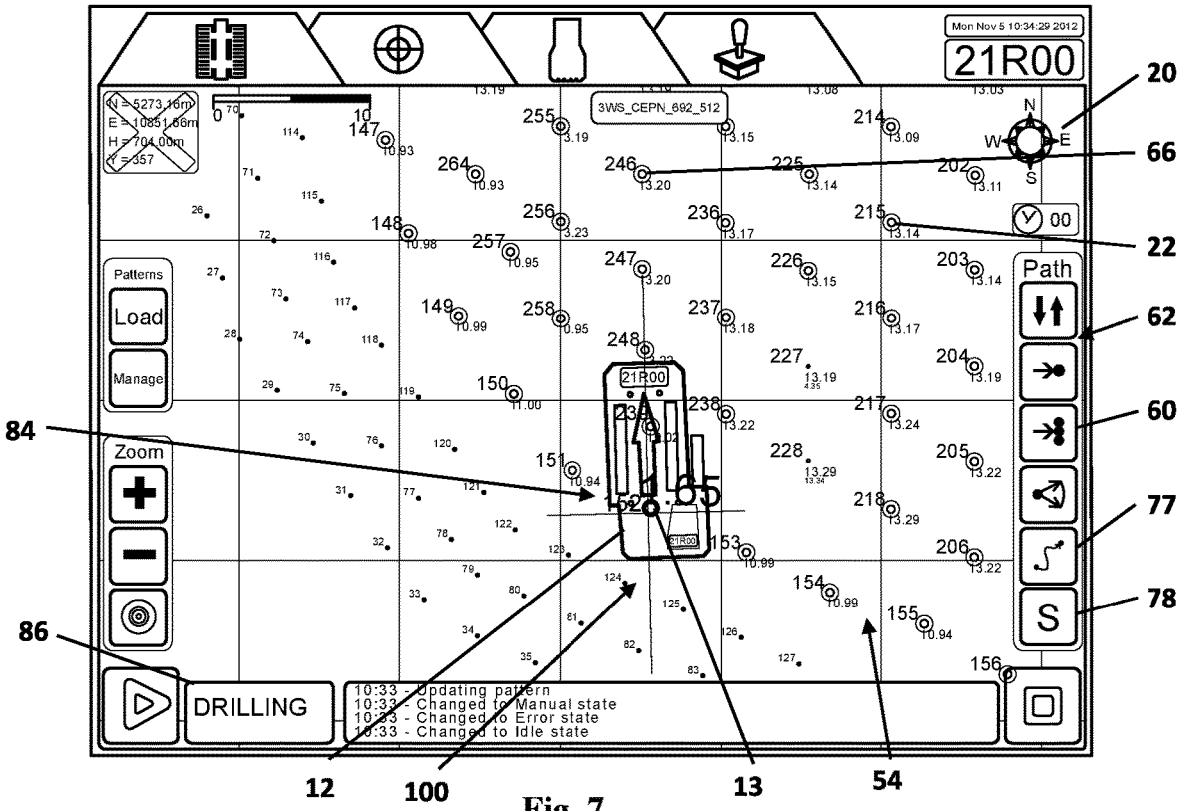

Once the corridor 102 has been generated by the equipment 14, the path within the corridor 102 for the drill rig 12 to follow is highlighted on the display as shown at 76 in FIG. 6 of the drawings. The path 76 to be followed is generated by the operator pressing a path planning button 77 of the array 62 of buttons. The path passes through each of the drill hole locations lying in the corridor 102 and, in use, the drill rig 12 trams so that the drill string 13 is centred on the path 76.

The operator is prompted to press a start button 78 of the array 62 of buttons which commences automated operation of the drill rig 12. Hence, as shown in FIG. 6 of the drawings, once the start button 78 has been pressed, the status of the drill rig 12 changes from "idle" as shown at 80 in FIGS. 2-5 of the drawings to "tramming" as shown at 81 in FIG. 6 of the drawings.

The drill rig 12 trams (the state shown in FIG. 6) from its initial location to a first location 84 (FIG. 7) on the path 76 at which a hole labelled "152" is to be drilled. At this location 84, the drill string 13 of the drill rig 12 is positioned directly above the first drill hole location "152". When the drill rig 12 is positioned at location 84 in the corridor 102, a drilling operation commences automatically and the drill hole labelled "152" is drilled to the required depth. The status of the drill rig 12 is shown as "drilling" as shown at 86 in FIG. 7 of the drawings.

Figure 8:
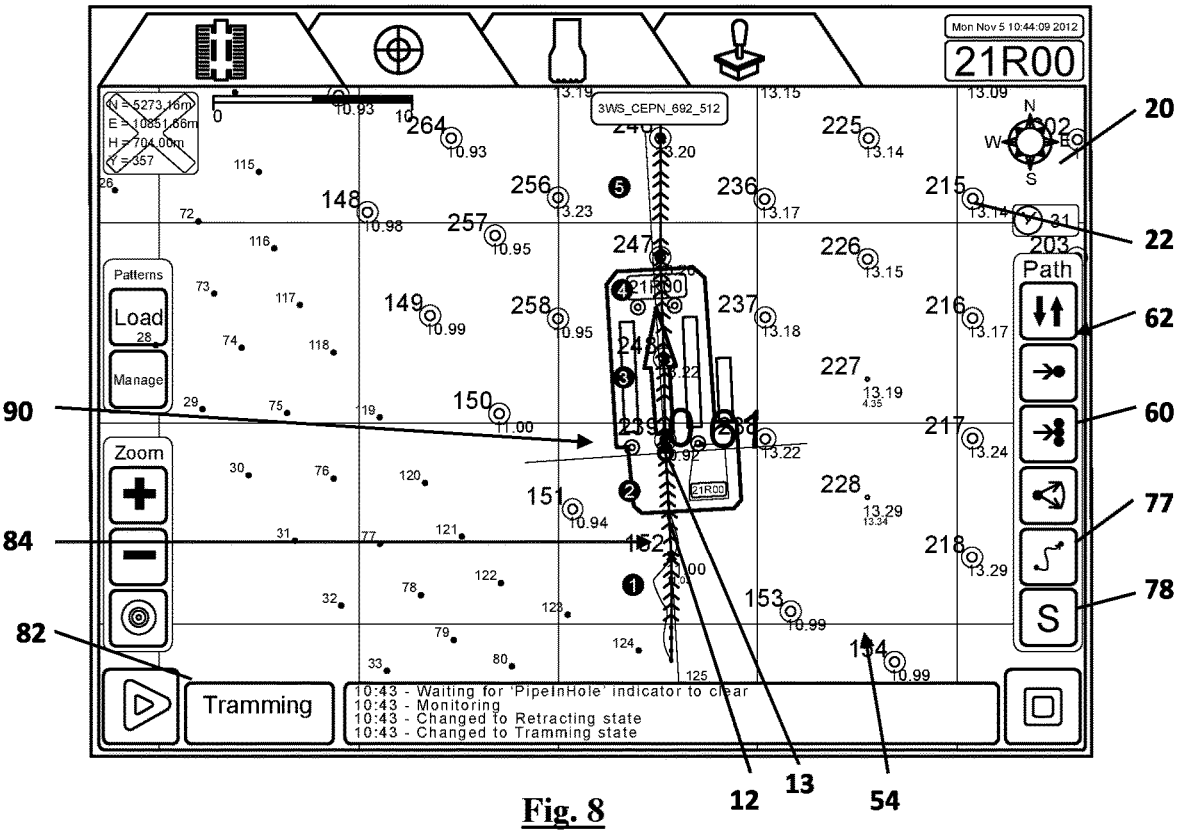

Upon completion of drilling the blast hole "152" at the location 84, the drill rig 12 automatically raises its drill string 13 and trams to a second location 90 in the corridor 102 where the drill string 13 is positioned directly over the location on the bench where a second hole, labelled "239" is to be drilled as shown in FIG. 8 of the drawings. This operation occurs without operator intervention. At this location 90, the blast hole is drilled to the required depth.

The process of drilling and tramming is repeated until the drill rig 12 has drilled holes at all the locations sequentially in the corridor 102 up to and including the last hole labelled "246" at the destination location 66. Once the last hole "246" has been drilled, the drill rig 12 switches to an idling state and awaits further input from the drill operating system 16. The tramming and drilling step is shown at step 75 in FIG. 9 of the drawings.

While the drill hole sequence plan has been described with reference to the destination location 66 being a drill hole location for the hole labelled "246", it will be appreciated that the destination location need not necessarily be a drill hole location. The destination location could be any other suitable end position for the drill rig 12. For example, the corridor may be planned along the last sequence of holes to be drilled in the blast pattern after which the drill rig 12 is to leave the bench 20. To minimise the possibility of the drill rig 12 traversing already drilled holes in the bench 20 or to require the drill rig 12 to carry out undesirable manoeuvres, such as executing sharp turns, the destination location may be an egress point (not shown) from the bench 20.

Further, while the illustrated path 76 is shown as a substantially rectilinear path, it will be appreciated that this need not be the case and the drill rig 12 may follow a zigzag path to have the drill string 13 intersect drill hole locations within the corridor 102. In addition, the path 76 may include curved portions where applicable.

Figure 10:
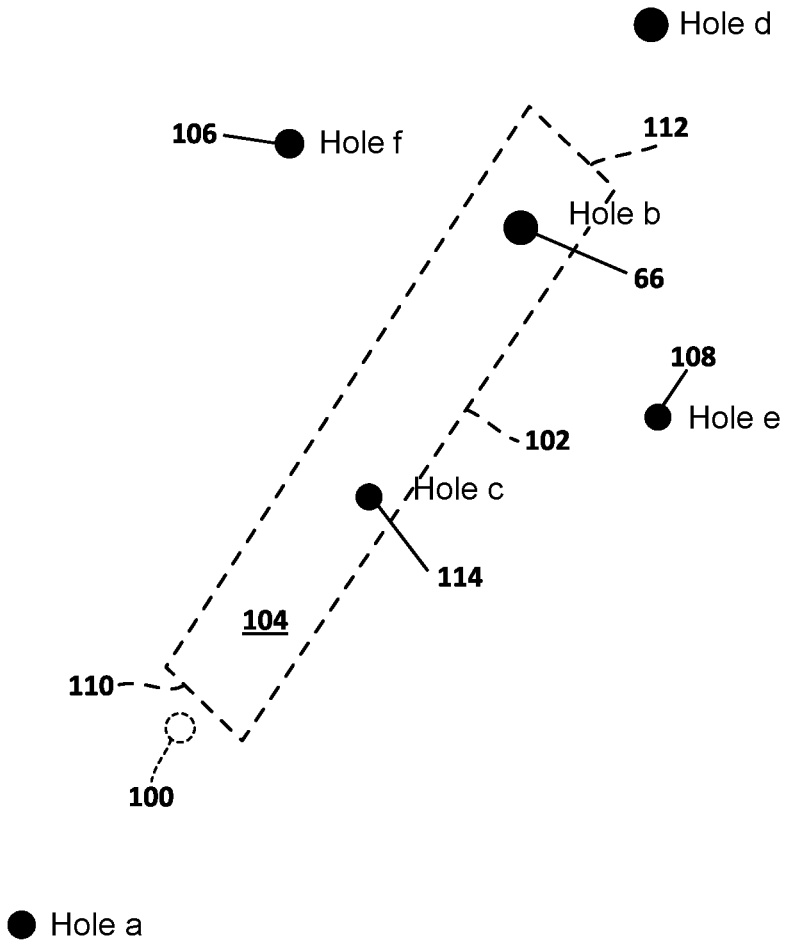
FIG. 10 shows a schematic representation of the establishment of a corridor for use by the drill hole sequence planning equipment.

Referring to FIG. 10 of the drawings, the establishment of the corridor 102 by the module 26 is described in greater detail. Firstly, an available rectangular area 104 is determined by the module 26 from a knowledge of the initial location of the drill string 12, the destination location 66 and a set width of the corridor 102. One factor which plays a part in determining the available area 104 is neighbouring blast hole locations, such as blast hole locations 106 and 108, which are to be excluded as they would require the drill rig 12 to execute undesirable manoeuvres such as turning too sharply to reach the blast hole locations.

For this purpose too, a start location 110 of the corridor 102 is spaced, or offset, a predetermined distance downstream of the initial location 100 of the drill rig 12. This is to exclude any hole locations which could be laterally located up to 90° relative to the position of the drill rig 12 and which would require undesirable manoeuvring of the drill rig 12 to reach such a lateral hole location.

A downstream end 112 of the corridor 102 is selected by the corridor establishment module 26 to be positioned downstream of the destination location 66 to take into account lack of precision of floating points. If the downstream end 112 of the corridor 102 were generated to overlie the destination location 66 exactly, it is possible that the destination location 66 could be excluded due to this lack of precision.

Once the desired area 104 of the corridor 102 has been determined, the corridor establishment module 26 determines which hole locations lie in the area 104. This is effected using data from the blast hole pattern 54 previously input into the system 16. In the example illustrated in FIG. 10 of the drawings, one blast hole location 114, in addition to the blast hole location at the destination location 66, is shown as falling within the corridor 102.

The module 26 orders the sequence in which holes are to be drilled at the locations 114 and 66 based on the positions of the locations 114 and 66 relative to the initial location 100 of the drill rig 12. The module 26 plans a single path from the initial location 100 of the drill rig 12 to the first hole location 114 in the corridor 102 and, then, from the first hole location 114 to the destination location 66. In other words, the module 26 determines the sequence in which the holes are to be drilled at the locations 114 and 66. It is to be noted that the path 76 described above with reference to FIGS. 5-8 of the drawings, in use, lies as close as possible to a centre line of the rectangular area 104 defining the corridor 102.

It is also to be noted that the above description of the establishment of the corridor 102 is to explain how the corridor 102 is generated and, for this purpose, has been limited to only a single hole location 114 between the initial location 100 of the drill rig 12 and its destination location 66. In practice, there will generally be a greater number of hole locations between the initial location 100 and the destination location 66 as described above with reference to FIGS. 2-8 of the drawings.

Figure 11:
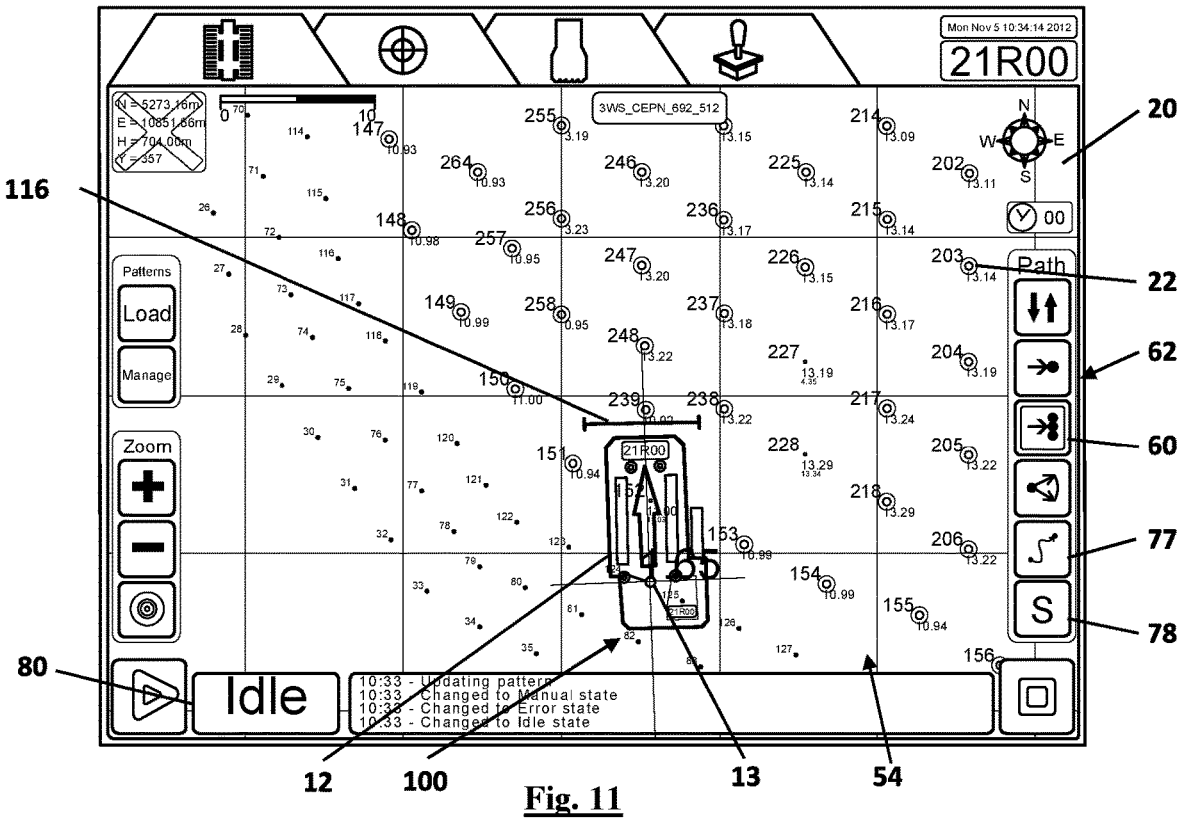
FIGS. 11 and 12 show screen shots of an initial stage of another embodiment of a method of operating a drill rig.
Figure 12:
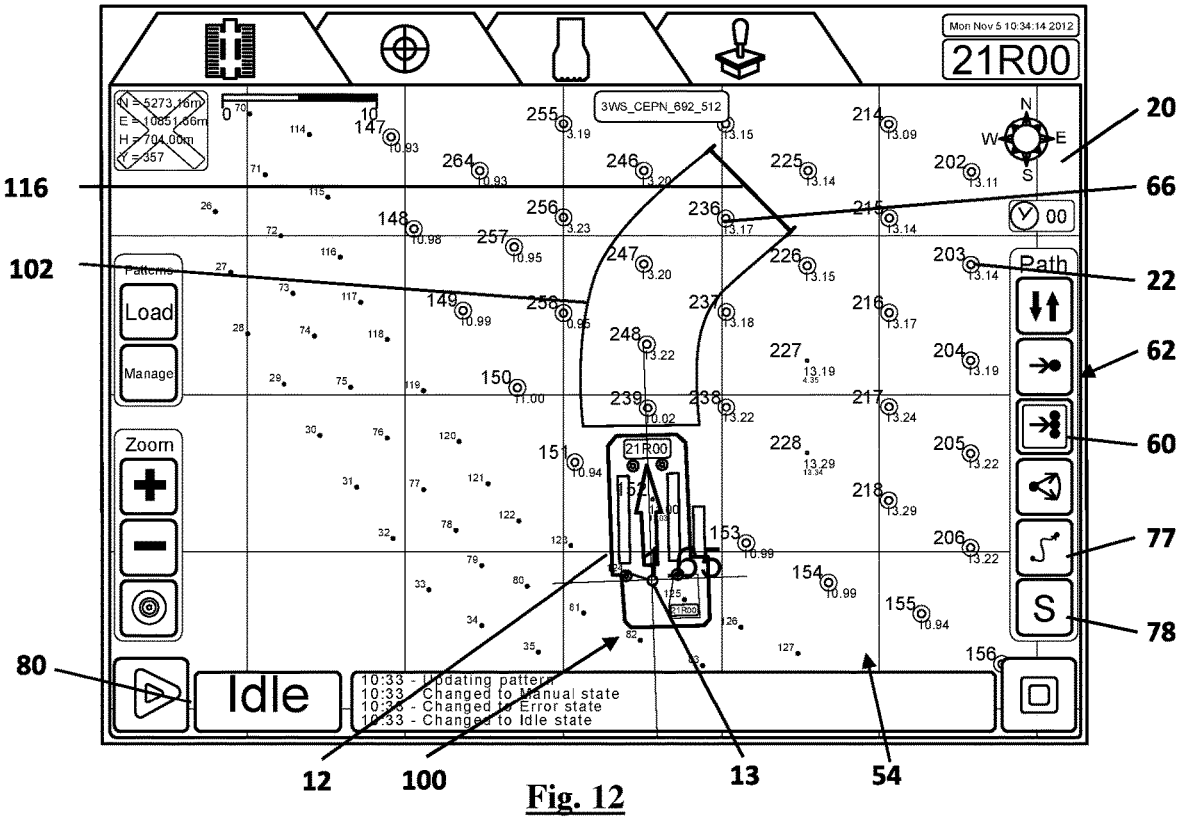

Referring now to FIGS. 11 and 12 of the drawings, another embodiment of a method of operating the drill rig 12 is described. With reference to previous embodiments, like reference numerals refer to like parts unless otherwise specified.

In this embodiment, the corridor 102 is configured manually by an operator using the user interface 44, for example, a touchscreen facility of the display 46 of the user interface. 44. The operator, noting the initial location 100 of the drill rig 12 sets the start location 110 of the corridor 102 by drawing a line 116 on the display downstream of the leading end of the drill rig 12. The length of the line 116 governs a width of the corridor 102 to be formed.

The operator then drags the line 116 over the display 46 in such a manner so as to establish the desired corridor 102. It is to be noted that, in this embodiment the corridor 102, instead of being rectilinear, is arcuate with a radius of curvature selected to facilitate appropriate tramming by the drill rig 12 along the corridor 102.

The remainder of the drilling procedure is as described above with reference to FIGS. 2-10 of the drawings.

It is an advantage of the described embodiments of the disclosure that a method, equipment and a system are provided which facilitate autonomous operations of drill rigs, in particular, tramming and drilling operations. Due to the fact that multiple drill hole locations are covered by the corridor and are selected in a single operation by the operator, continuous inputting of destinations by the operator for the autonomous drill is obviated. Thus, a number of drill holes can be drilled without operator input. Hence, the efficiency of the autonomous drilling operation is improved resulting in improved overall mine productivity.

It is a further advantage of the described embodiments that a corridor 102 is generated for the drill rig 12 which factors into account desirable operating parameters of the drill rig 12, provides a known safe bound for the path of the drill rig 12 and seeks to exclude manoeuvres which are undesirable, such as causing the drill rig 12 to execute sharp turns, which is detrimental to the operating performance of the drill rig 12 and which can also have an adverse impact on the bench 12.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A method of generating a drill hole sequence plan, the method including using a navigation unit, providing location information of a mobile drill rig to a processing unit, the processing unit providing the location information to a position determining module, the position determining module automatically determining an initial location of the mobile drill rig;

selecting a destination location of the drill rig via a user interface and using a pre-loaded hole pattern;

establishing a corridor between the initial location of the drill rig and its destination location, the corridor being based on the initial location of the drill rig, the destination location of the drill rig, and a selected width of the corridor, wherein the selected width provides a known safe bound of a path of the drill rig and the corridor covers a plurality of drill hole locations of said pre-loaded hole pattern;

using the pre-loaded hole pattern, automatically selecting a hole location of each hole within the corridor to be drilled by the drill rig sequentially as it moves from its initial location to its destination location; and providing the drill hole sequence plan to a controller of the drill rig so that the controller, using the location information from the navigation unit, controls automated tramming of the drill rig to the selected hole locations sequentially.

2. The method of claim 1 which includes an operator manually selecting a width of the corridor.

3. The method of claim 1 which includes performing a distance check to see if a hole location falls within, or within a configurable distance from, the corridor.

4. The method of claim 3 which includes configuring the corridor to cover hole locations along a tramming path of the drill rig from its initial location to its destination location.

5. The method of claim 1 which includes selecting an end hole location as the destination location of the drill rig.

6. The method of claim 1 which includes generating a start position of the corridor at a location which is spaced from the initial location of the drill rig.

7. A method of operating a drill rig, the method including providing to a drill rig controller a drill hole sequence plan as generated using the method of claim 1; and causing the drill rig, which is responsive to the drill rig controller, to drill a hole automatically at each hole location sequentially along its path as the drill rig traverses the corridor.

8. Drill hole sequence planning equipment which includes a navigation unit which receives data from various input devices and which generates location information of a mobile drill rig;

a processing unit in communication with the navigation unit and responsive to the location information to determine an initial location of the mobile drill rig;

a user interface in communication with the processing unit via which a destination location for the drill rig is selected, the selection further being based on a hole pattern pre-loaded into the processing unit;

wherein the processing unit is responsive to the determination of the initial location and the selection of the destination location to establish a corridor between the initial location of the drill rig and its destination location, the corridor being based on the initial location of the drill rig, the destination location of the drill rig, and a selected width of the corridor, wherein the selected width provides a known safe bound of the drill rig and the corridor covers a plurality of drill hole locations of the pre-loaded hole pattern, the processing unit selecting a hole location of each hole within the corridor to be drilled by the drill rig sequentially as it moves from its initial location to its destination location; and a communications link to provide a drill hole sequence plan to a controller of the drill rig so that the controller, using the location information from the navigation unit, controls automated tramming of the drill rig to the selected hole locations sequentially.

9. The equipment of claim 8 which is configured to enable an operator manually to select a width of the corridor.

10. The equipment of claim 8 which includes an inputting module to enable a drill hole pattern to be entered into the processing unit.

11. The equipment of claim 8 in which the processing unit is configured to generate the corridor to include/exclude hole locations.

12. The equipment of claim 11 in which the processing unit is configured to conduct a distance check on a hole location to determine if it should be included in, or excluded from, the corridor.

13. The equipment of claim 8 in which the processing unit is configured to generate a start position of the corridor at a location which is spaced upstream from the initial location of the drill rig.

14. A drill rig control system which includes drill hole sequence planning equipment as claimed in claim 8; and a drill controller, to which the drill rig is responsive, in communication with the drill hole sequence planning equipment.

15. The control system of claim 14 in which the controller is mounted on board the drill rig, the controller communicating wirelessly with the drill hole sequence planning equipment.

16. A drill rig which is responsive to drill hole sequence planning equipment as claimed in claim 8.

17. The method of claim 3 which includes excluding hole locations from the corridor which would require the drill rig to execute undesirable maneuvers.

18. The equipment of claim 12 in which the processing unit is operative to exclude hole locations from the corridor which would require the drill rig to execute undesirable maneuvers.

* * * * *